US007328482B2

(12) United States Patent
Elmer

(10) Patent No.: US 7,328,482 B2
(45) Date of Patent: Feb. 12, 2008

(54) FITTING SYSTEM

(75) Inventor: Hubert Elmer, Innsbruck (AT)

(73) Assignee: Dorma GmbH + Co. KG., Ennepetal (DE)

( * ) Notice: Subject to any disclaimer, the term of this patent is extended or adjusted under 35 U.S.C. 154(b) by 232 days.

(21) Appl. No.: 10/494,428

(22) PCT Filed: Nov. 5, 2002

(86) PCT No.: PCT/EP02/12321

§ 371 (c)(1),
(2), (4) Date: Apr. 23, 2004

(87) PCT Pub. No.: WO03/039224

PCT Pub. Date: May 15, 2003

(65) Prior Publication Data

US 2004/0261222 A1 Dec. 30, 2004

(30) Foreign Application Priority Data

Nov. 5, 2001 (DE) ..... 101 53 824

(51) Int. Cl.
*E05D 5/02* (2006.01)
*E05D 11/00* (2006.01)
*E05D 7/08* (2006.01)

(52) U.S. Cl. ..... 16/252; 16/253; 16/250; 16/273; 16/382; 16/378

(58) Field of Classification Search ..... 16/252, 16/253, 250, 273, 382–384, 378
See application file for complete search history.

(56) References Cited

U.S. PATENT DOCUMENTS 3,555,733 A * 1/1971 Horgan, Jr. ..... 49/388

(Continued)

FOREIGN PATENT DOCUMENTS

DE 3705129 A1 * 9/1988

(Continued)

*Primary Examiner*—Flemming Saether
*Assistant Examiner*—David C Reese
(74) *Attorney, Agent, or Firm*—Cohen Pontani Lieberman & Pavane LLP

(57) ABSTRACT

The invention relates to a fitting system according to parent application DE 101 19 987.3 for rotatably bearing a door leaf (2) in a glass construction. A fitting (1) is disposed on the top and/or at the bottom of said door leaf (2) and interacts with a complementary counter-fitting. A bearing axis extends in the plane of the door leaf and every fitting (1) is subdivided longitudinally by an intermediate space (3), while forming opposite bearing surfaces (7, 8), into at least partially spaced-apart fitting elements (4, 5) that can be disposed in a form-fit in a recess (9) of the door leaf (2). In order to stabilize the fitting system and to provide tamper-proof and protected fittings (1) that are also optically appealing, the fitting elements (4, 5) are fastened to the door leaf (2) by means of pins (16, 17) that are introduced at an angle to the longitudinal direction in through bores (14, 15) and in blind bores (12, 13) of the two fitting elements (4,5), while reducing the intermediate space (3). A rod stud (27) fastened to the one fitting elements (5) accommodates the two insertable pins (16, 17) while capping them, said rod stud (27) extending in parallel to the plane of the door leaf.

17 Claims, 10 Drawing Sheets

U.S. PATENT DOCUMENTS

| | | | | | |
|---|---|---|---|---|---|
| 4,365,385 | A | * | 12/1982 | Gotoh | 16/382 |
| 4,785,498 | A | * | 11/1988 | Brotschi | 16/238 |
| 5,025,531 | A | * | 6/1991 | McCarty | 16/313 |
| 5,499,896 | A | * | 3/1996 | Cafarelli | 411/387.2 |
| 5,867,869 | A | * | 2/1999 | Garrett et al. | 16/252 |
| 6,070,294 | A | * | 6/2000 | Perkins et al. | 16/252 |
| 6,249,426 | B1 | * | 6/2001 | O'Neal et al. | 361/681 |

FOREIGN PATENT DOCUMENTS

| | | | |
|---|---|---|---|
| DE | 199 59 530 | | 6/2001 |
| DE | 101 19 897 | | 8/2002 |
| EP | 237789 | A2 * | 9/1987 |

* cited by examiner

FITTING SYSTEM

PRIORITY CLAIM

This is a U.S. national stage of application No. PCT/EP02/12321, filed on 5 Nov. 2002. Priority under 35 U.S.C. §119(a) and 35 U.S.C. §365(b) is claimed from German Application No. 101 53 824 3, filed 5 Nov. 2001.

BACKGROUND OF THE INVENTION

1. Field of the Invention

The invention relates to a fitting system for rotatable support of a glass door leaf having a top, a bottom, a bearing axis extending between the top and the bottom in the plane of the door, and a mourning recess on the axis at the top and the bottom, the fitting system including a pair of fittings received in respective mounting recesses, each fitting having a fist fitting part, a second fitting part, an intermediate space between the fitting parts, a contact surface facing the intermediate space on each of the fitting parts.

2. Description of the Related Art

A hardware fitting system of this type is known from DE 101 19 897 and DE 199 59 530. Door leaves, made preferably of glass, are rotatably supported in a surrounding frame construction by means of fittings at the top and/or at the bottom. By the use of various counter-fittings, the fitting system can be adapted to frame constructions of masonry and to those of panel-shaped elements such as glass. The door leaves can be used for both single-leaf and double-leaf swinging doors or doors with stops The rotational support fittings cooperate with the counter-fittings installed on the frame, and the complementary bearing elements engage rotatably in each other. The rotational support fittings are divided into two at least partially separate parts by an intermediate space extending in the longitudinal direction. Two opposing contact surfaces are thus formed. The two parts of the fitting can be attached to the door leaf by screws, which can be turned in the direction perpendicular to the longitudinal direction to reduce the size of the intermediate space.

The problems with rotational support fittings of this type arise from the arrangement of the fittings and also from the arrangement of the screws. Because the loads are transmitted exclusively via the fittings, which are mounted in the plane of the door leaf, it is possible for undesirable stresses to develop in the door leaf.

After installation is complete, the screws continue to be accessible to anyone and are thus vulnerable to tampering and to contamination. In addition, the screws are easily visible and thus have the effect of subdividing the surface of the fitting, which spoils the overall visual impression.

SUMMARY OF THE INVENTION

It is the therefore the task of the invention to improve a fitting system so that the fittings are stabilized and the fittings are both tamper-proof and protected, and also so that a visually attractive unit is obtained. It is a goal of the invention to simplify the installation of the fitting disclosed DE 101 19 897.

According to the invention, a pair of threaded blind holes are provided in the first fitting part, a pair of through holes are provided in the second fitting part, and a pair of pins are received in the through holes and threaded into the blind holes for drawing the contact surfaces against the door leaf.

The pins that extend across the fitting are covered by a extension bar, which can be attached positively to the fitting. The inventive door fitting thus offers the advantage of a tamper-proof and visually attractive design, The surface of the fitting and of the extension bar are free of "breaks" and can be adapted to suit the overall design, so that the fitting and the extension bar from a single visual unit.

The fitting is divided into two parts by an intermediate space extending in the longitudinal direction; these two parts are connected to each other by a web and thus form a single piece. The door leaf is clamped in place between these two parts of the fitting. The extension bar is attached to one of the two fitting parts, as a result of which the pins that extend across the fitting parts are secured in their positions and covered. The extension bar is parallel to the plane of the door leaf and can carry a stabilizing rod outside the fitting, which can be connected to the door leaf, if desired. As a result, additional attachment points are created, which help to eliminate stresses within the door leaf.

The inventive arrangement and design of the two pins inside the extension bar simplifies the installation of the fitting. In the first step of the installation process, the fitting is attached nonpositively to the door leaf. Transverse bores inside of the extension bar then cap the projecting heads of the transverse pins. Radially oriented grooves pass around the circumference of the heads of the two pins. The extension bar can then be connected mechanically to the pins by means of screws, which can be screwed axially into the extension bar at the top and bottom so that they can engage in the grooves in the heads of the pins and exert a clamping action on them.

When the door leaf is installed close to the floor and the fitting is installed at the bottom of the door leaf, the threaded screw which is screwed into the bottom part of the extension bar is completely inaccessible because of the smallness of the gap between it and adjacent horizontal surfaces. The fitting is thus tamper-proof.

So that a defined clamping force can be applied during the installation of the fitting, the two pins are provided with threaded sections, which can be screwed into the fitting parts until they exert the desired clamping force. The groove provided in the head of each pin acts as a positioning aid, because the extension bar can be positioned positively in the receiving channel only after the pins have been screwed in far enough, and only then can the screws be screwed completely into the grooves.

So that the pins can be installed without causing damage, axially recessed hexagon sockets are formed in the heads of the pins. As a result, a tool can be positively engaged in the socket, and at the same time the pins are protected from damage. Tangential opposing surfaces that can be gripped by a wrench or hexagonal heads are also conceivable.

In one embodiment, the extension bar covering the two pins can be extended to form a stabilizing gripping rod, which, if desired, can proceed from the upper to the lower fitting of the door leaf. At the connecting points between the bar and the rod or at any other desired points on the rod, connections to the door leaf can be created in the form of so-called "point fittings", which pass through the glass.

O-rings are inserted into ring-shaped grooves in the terminal sections of reduced diameter of the rod. The rod and the bar are then inserted into each other, the extension bar being provided for this purpose with a bore area of enlarged cross section. When the rod is inserted into the bar, the O-rings are put under pressure and thus form a sufficiently strong nonpositive connection. This type of connection simplifies assembly and disassembly.

So that the door leaf with preinstalled fittings can be installed easily between the upper and lower bearing pins projecting into the door opening on the bearing axis of the door, one of the two fittings has an area which can be opened at the side. For this purpose, it is advantageous for the bearing space of a fitting to have a side which can be opened. A bearing body equipped with a bushing is premounted on the corresponding bearing point on the frame, so that the door leaf can then be pivoted into alignment with the bearing axis of the door leaf, as a result of which the bearing body becomes enclosed within the space which is open on one side. The bearing body is thus held in position in the bearing space, but it still allows the door leaf to be aligned accurately with the bearing axis. The open side of the bearing space can be closed off by a cover, which can be inserted so that its surface is flush with its surroundings to produce a uniform visual appearance. Clips provided along one of the lateral edges are preferably used to attach the cover.

The fitting, the extension bar, and the stabilizing rod or its individual parts can be made of various metals such as brass, iron, special steel, aluminum, or bronze; out of a suitable plastic with the necessary strength; or out of appropriate composite materials. The fitting, the extension bar, and the stabilizing rod are advantageously manufactured as integral parts by a casting process and then precision-machined to final dimensions. The flowing external contour reduces the difficulty of producing such components by casting.

DETAILED DESCRIPTION OF THE PRESENTLY PREFERRED EMBODIMENTS

Figure 1:
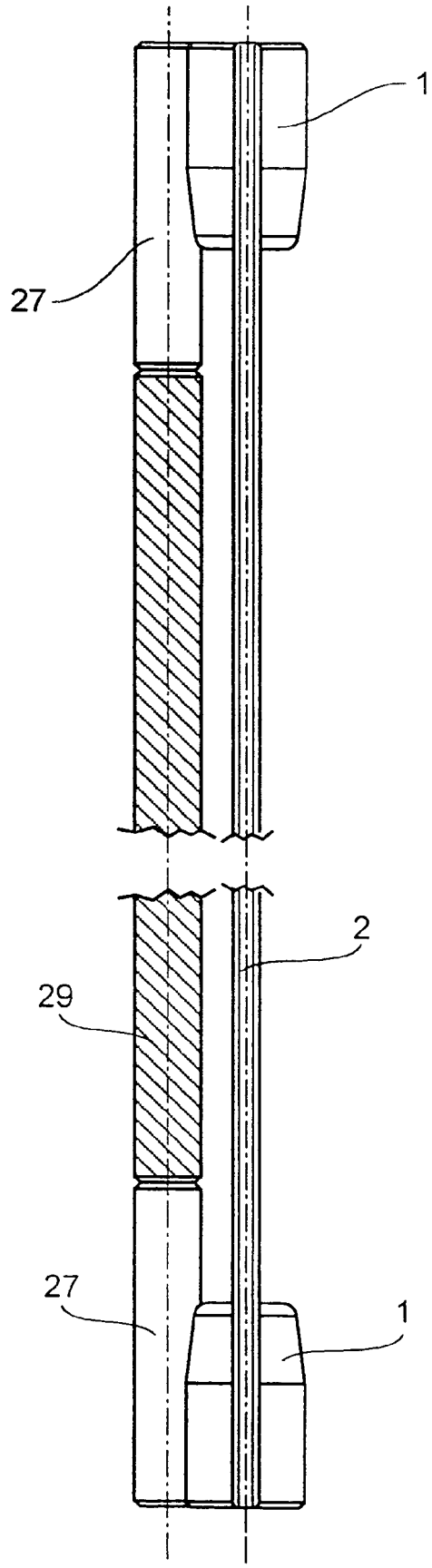
FIG. 1 shows a partial cross section through a fitting system, including a stabilizing rod, mounted on a door leaf.
Figure 2:
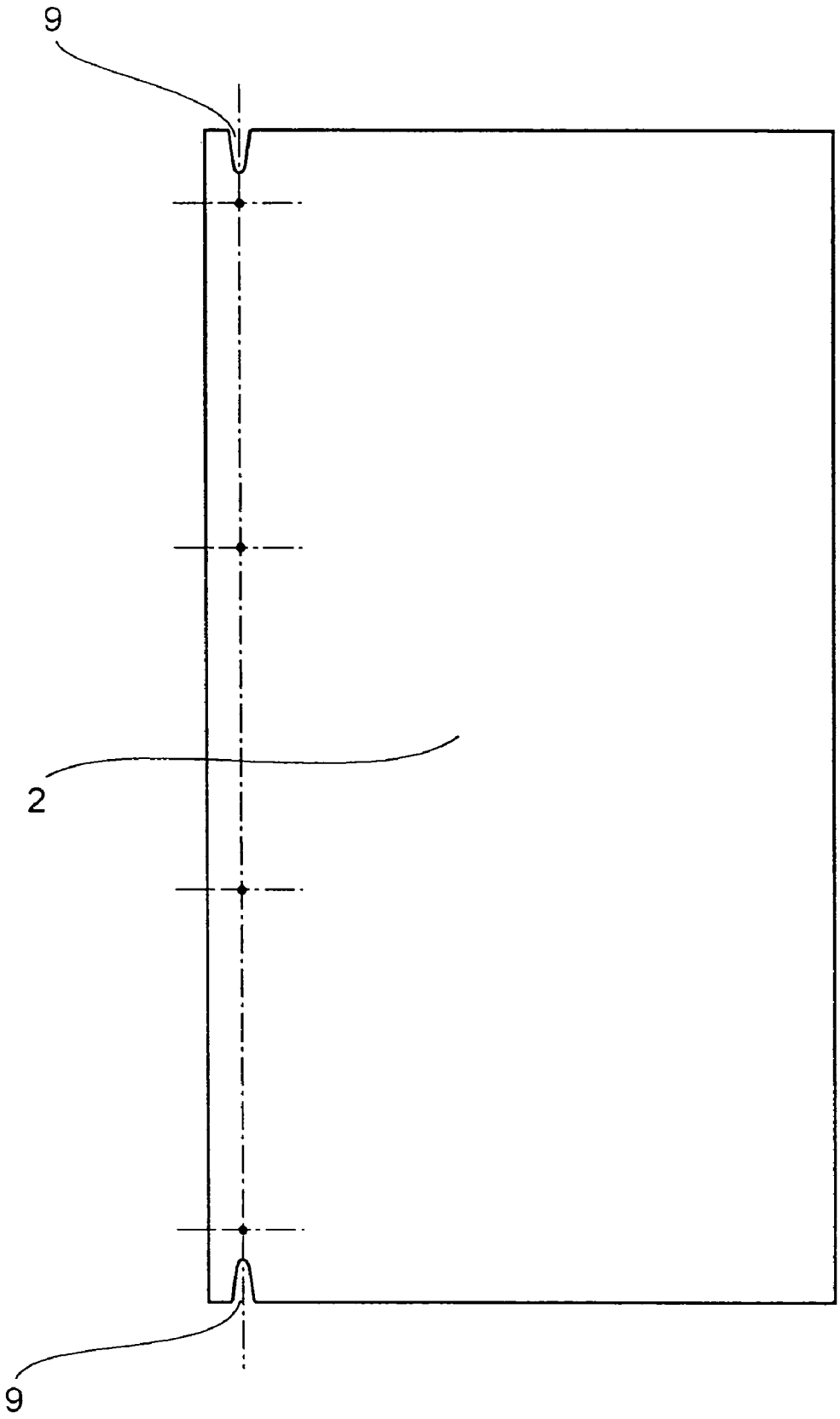
FIG. 2 shows a front view of a door leaf with appropriate recesses.

The same or equivalent components are provided with the same reference numbers in the following description.

A fitting system consists conventionally of several fittings and counter-fittings; in the following description, two fittings of different design are presented in detail, each of which must be used once on a door leaf to ensure ease of installation. Each of the two fittings is designated by the same reference number 1.

The fitting 1 serves basically as a means of supporting a door leaf 2, preferably a door leaf made of glass, which is mounted rotatably at the top and/or bottom in a surrounding construction of glass, where the bearing axis extends along the plane of the door. Various counter-fittings (not shown) make it possible to use frame constructions made of panels or of masonry. Door leaves 2 can be used both for one- or two-leaf swinging doors and for doors with stops.

The fitting is made of metal and has a preferably round cross section. It is divided into two parts 4 and 5 by an intermediate space 3 extending in the longitudinal direction; the two parts are connected to each other by a web 6 to form a single unit. The door leaf 2 is held by a clamping action between interior contact surfaces 7 and 8 of these fitting parts 4 and 5 (FIGS. 3 and 4).

Figure 3:
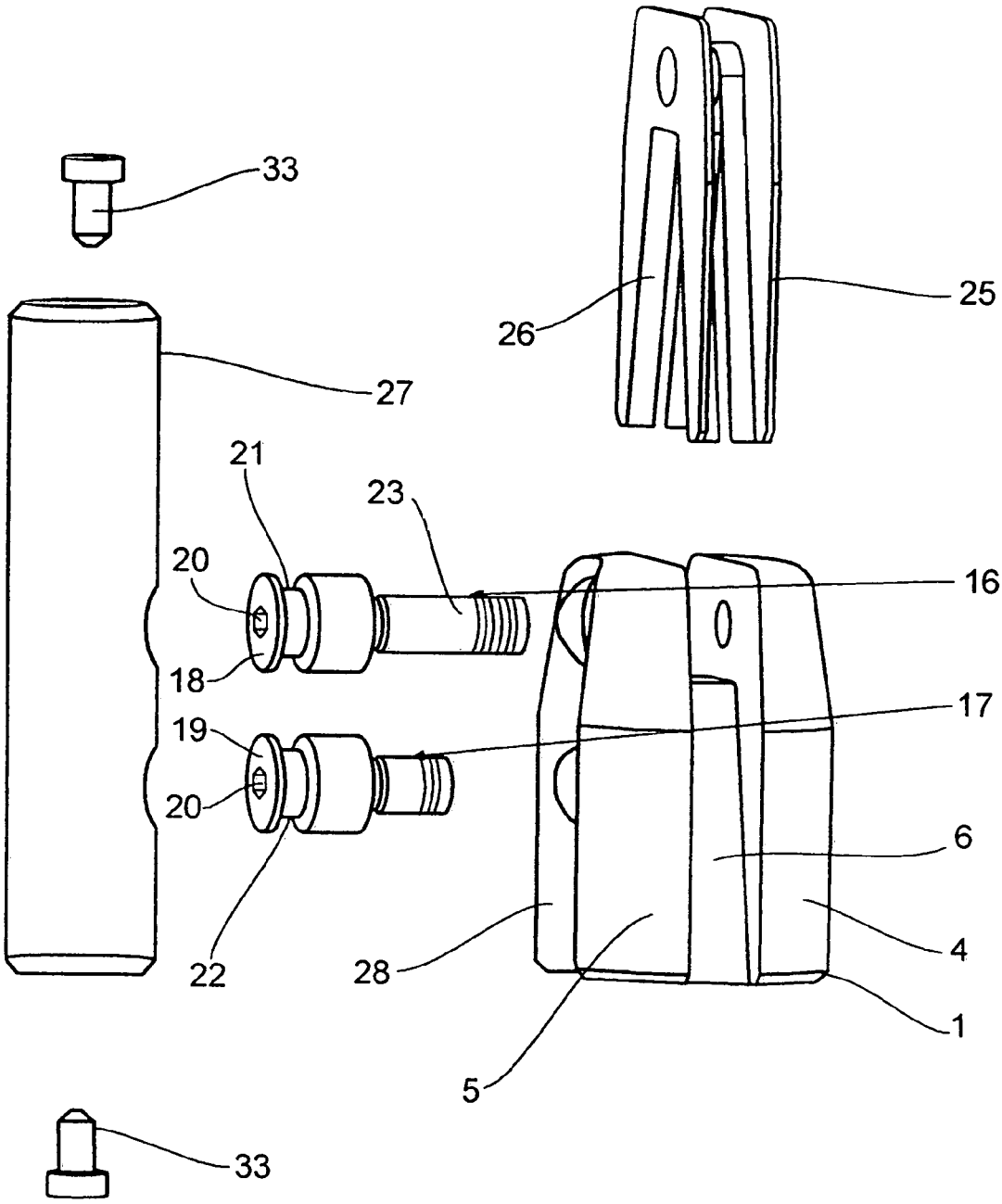
FIG. 3 shows an exploded view of a fitting according to the invention.
Figure 4:
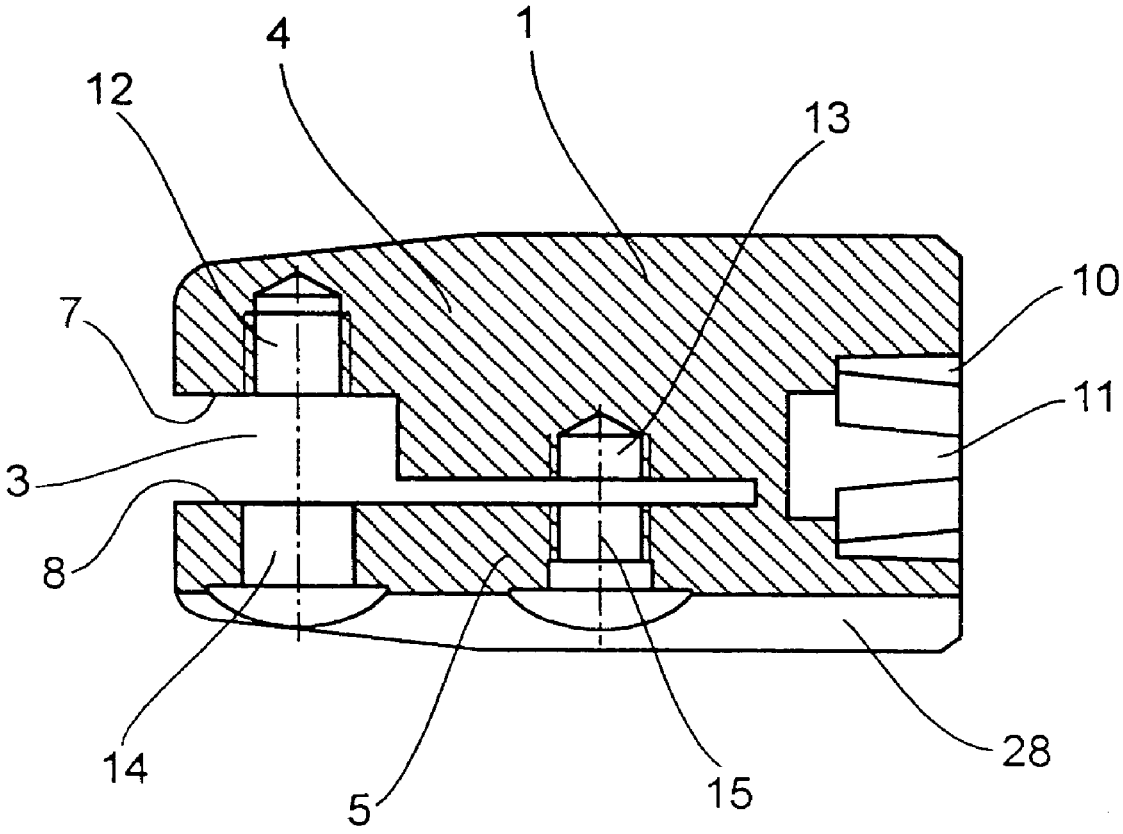
FIG. 4 shows a cross-sectional view of a fitting according to FIG. 3.

The fitting 1 according to FIGS. 3 and 4 can be mounted in an appropriate recess 9 at the bottom of the door leaf 2. In the web 6 of the fitting 1 there is a bearing space 10 with an integral rotational support body 11, which, for example, can accept the end of the closing shaft of a door closer (not shown) in both a positive and nonpositive manner. When the door leaf 2 is opened by hand, the door closer is put under tension, so that afterwards the door will close by itself.

Two parallel bores pass horizontally through the fitting parts 4 and 5; each of these bores is made up of a blind hole 12, 13 in the fitting part 4 and a through-hole 14, 15 in the fitting part 5. The blind holes 12, 13 are internally threaded. Two pins 16, 17 of different length are introduced into the bores; each pin has a head 18, 19, in which an axially recessed hexagonal socket 20 is formed. Each pin 16, 17 has a groove 21, 22, open in the radial direction, extending around the circumference and a threaded shaft 23. Protective inserts 25, 26 are placed between the sides of the door leaf 2 and the associated fitting parts 4, 5 to protect the surface of the glass. The protective inserts 25, 26 have appropriate holes, which line up with the bores. In addition, spacers (not shown) in the form of washers can also be provided between the fitting parts 4, 5, to limit the extent to which the fitting parts 4, 5 can approach each other and thus to limit the clamping force which they can exert when they are screwed against the door leaf 2.

Figure 5:
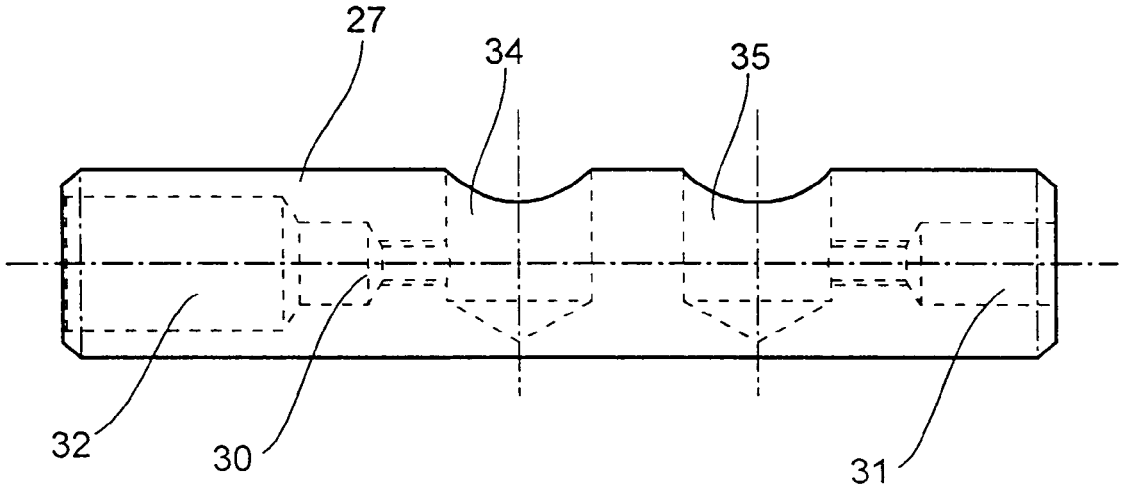
FIG. 5 shows a plan view of an extension bar.

A round extension bar 27 is attached to the fitting part 5; for this purpose, the fitting part 5 is designed with a receiving channel 28 in a certain area, in which the extension bar can fit in a positive manner. The extension bar 27 can be made even longer by means of a rod 29, which has a gripping or stabilizing element and which terminates in the upper fitting 1. As shown in FIG. 5, threaded bores 30, 31 penetrate axially into the extension bar 27 at the centers of both the top and bottom. The threaded bore 30 has a bore area 32 of enlarged cross section. Screws 33 can be screwed into these threaded bores 30, 31. In addition, the extension bar has two transverse bores 34, 35, which terminate the threaded bores 30, 31. These two transverse bores 34, 35 are the same distance apart as the corresponding bores 12, 13 and 14, 15 in the fitting parts 4 and 5.

Figure 6:
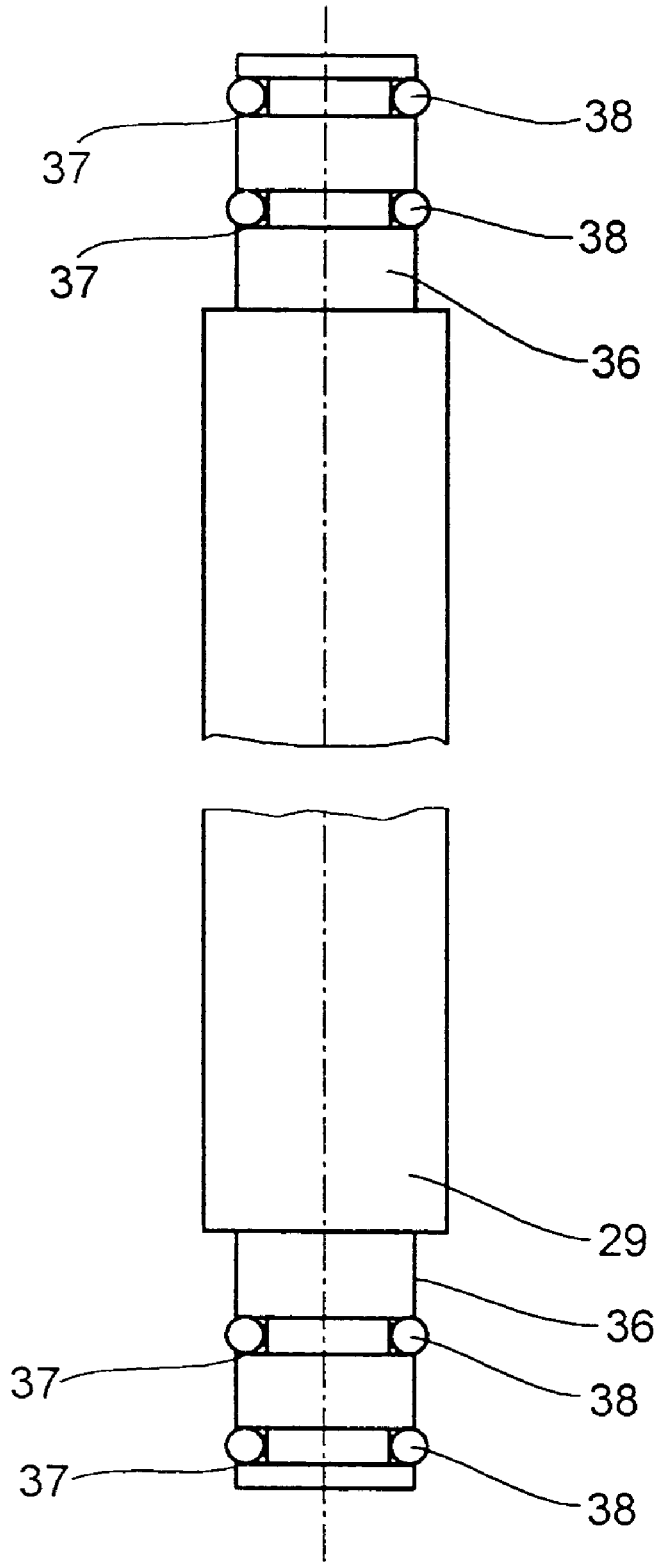
FIG. 6 shows a plan view of a stabilizing rod.
Figure 7:
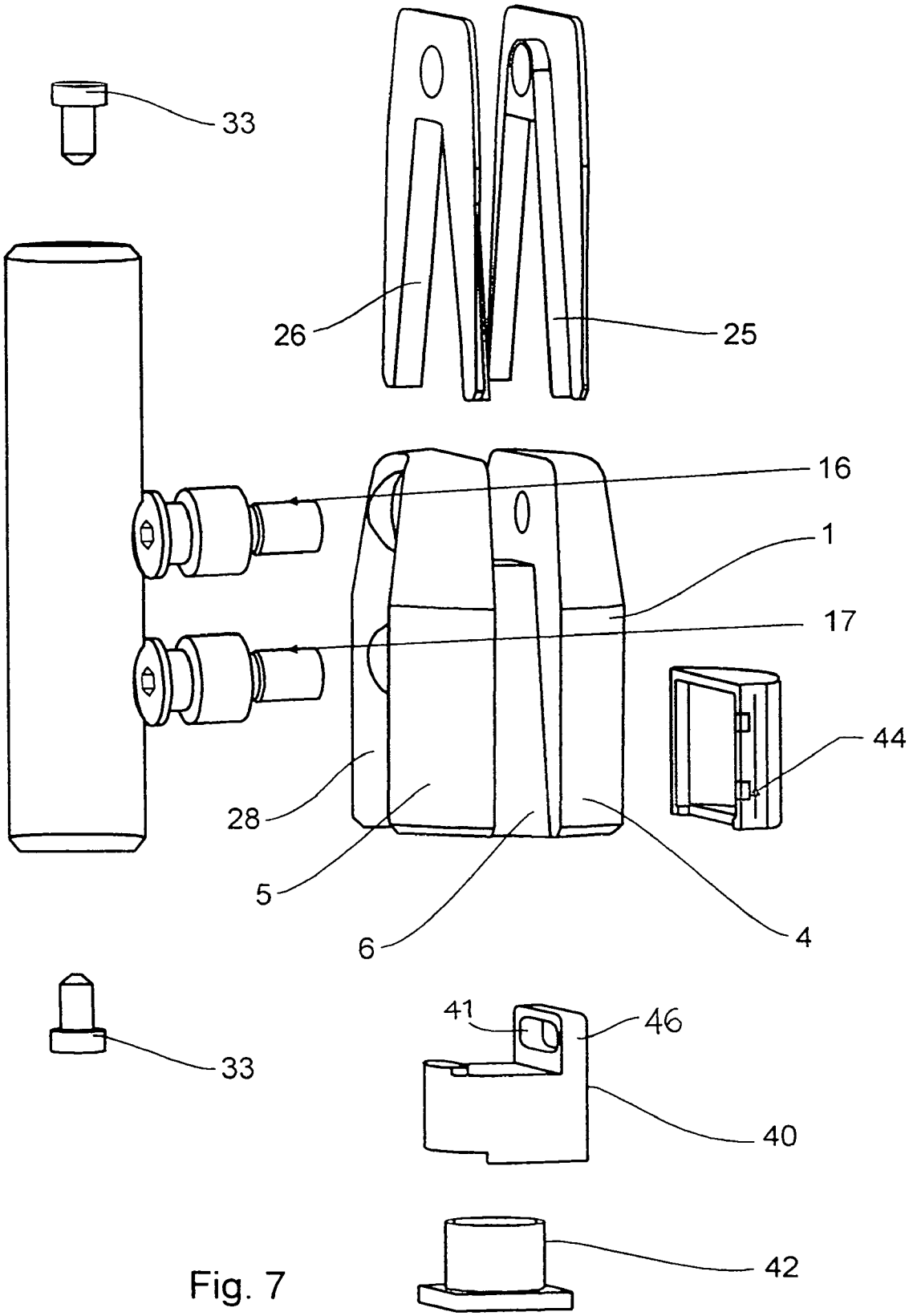
FIG. 7 shows an exploded view of another exemplary embodiment of a fitting.
Figure 8:
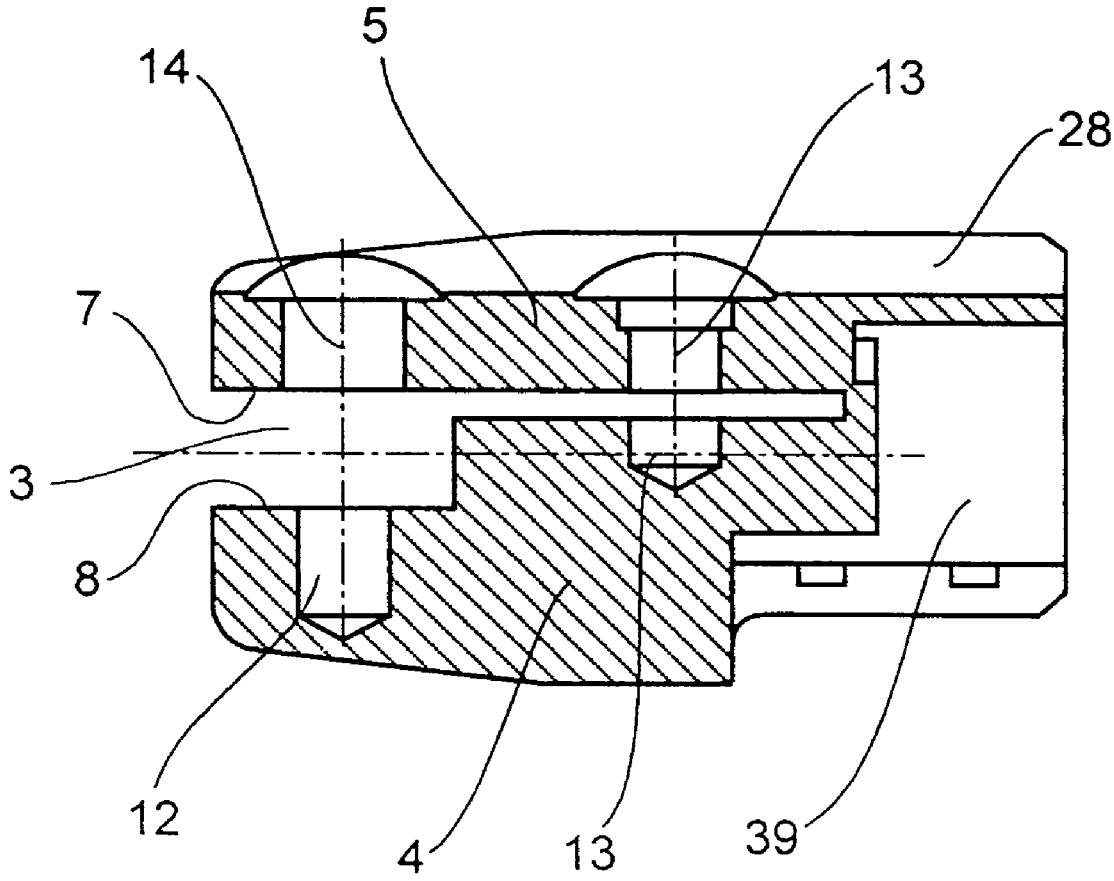
FIG. 8 shows a cross sectional view of the fitting according to FIG. 7.
Figure 9:
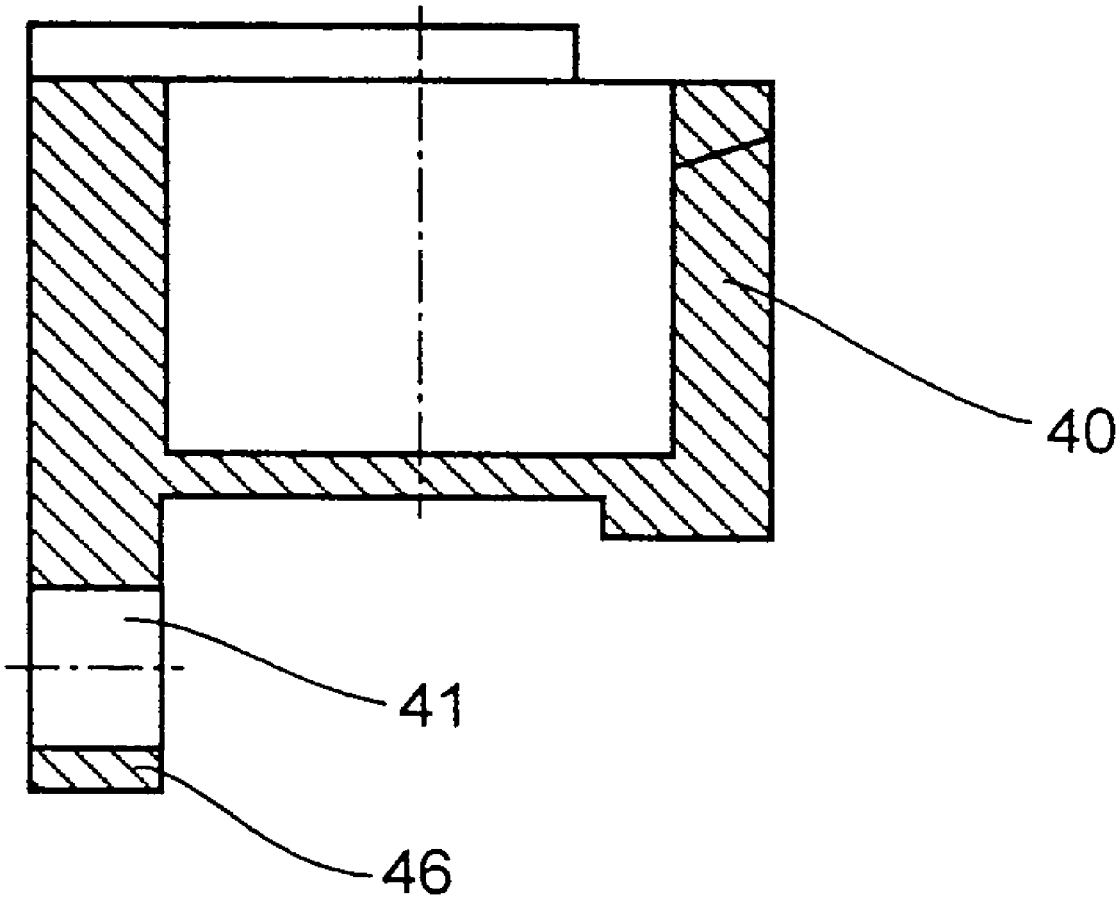
FIG. 9 shows a view of the bearing body according to FIG. 7.
Figure 10:
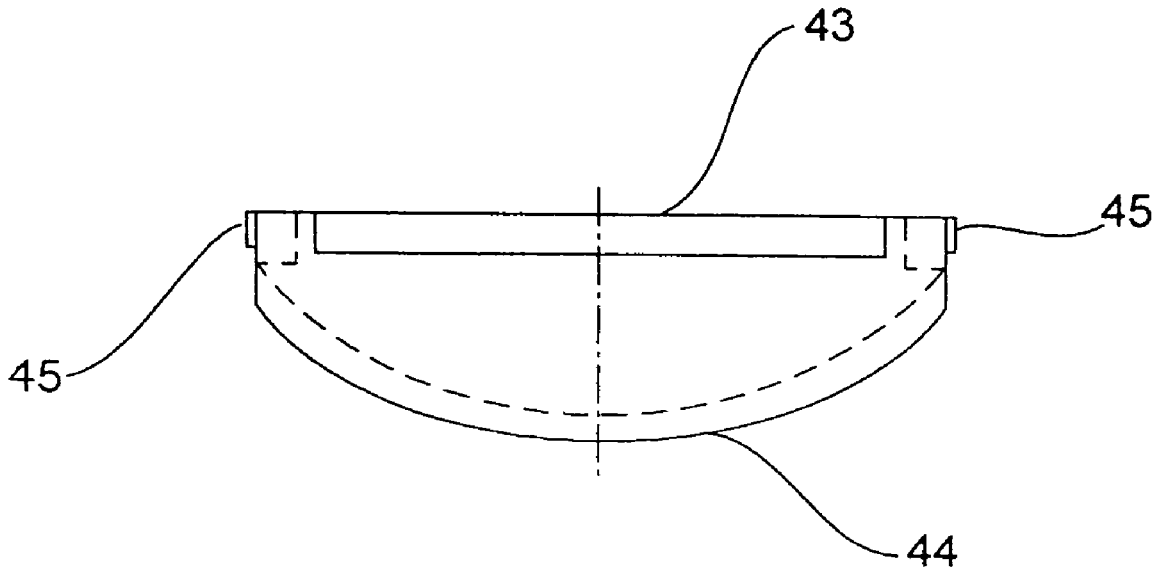
FIG. 10 shows a view of the cover according to FIG. 7.

The stabilizing rod part 29 according to FIG. 6 is provided at both ends with a terminal area 36 of reduced diameter. O-rings 38 are installed in ring-shaped grooves 37 formed in this terminal area 36.

Because the fittings 1 are premounted on the door leaf 2, one of the two fittings 1 is provided with an area which can be opened at the side so that the door leaf 2 with the premounted fittings 1 can be installed between the bearing pins which project into the door opening at the top and bottom on the bearing axis of the door.

According to FIGS. 7-10, a fitting 1 is provided for this purpose, which has a bearing space 39 which can be opened from the side. A bearing body 40 can be installed in this bearing space 39, where a screwed joint (not shown) passes through a mounting shoulder 46, formed as an integral part of the bearing body 40. So that the door leaf 2 can be adjusted to align precisely with the bearing axis, the mounting shoulder 46 is provided with a slot 41. Inside the bearing body 40 is a bushing 42, on which the bearing pin on the frame side is supported rotatably. The open side of the bearing space 39 can be closed by a cover 43. A lateral surface 44 of the cover 43 is convex, so that the cover 43 can be installed flush with the outside surface of the rest of the fitting 1, as a result of which a uniform visual appearance is obtained. Clips 45 are provided along the edge of the lateral surface 44 to attach the cover 43.

The fitting 1 is installed as follows. First, the door leaf 2 is clamped between the contact surfaces 7, 8 and the protective inserts 25, 26 of the fitting parts 4, 5. For this purpose, the two pins 16, 17 are screwed into the corresponding bores 12-15 to clamp the door leaf 2. Then the extension bar 27 with its two transverse bores 34, 35 is positioned positively over the heads 18, 19 of the pins, which project into the receiving channel 28. The extension bar 27 can now be connected mechanically to the pins 16, 17 by the screws 33, which can be screwed axially from the top and bottom into the threaded bores 30, 31 in the extension bar 27; these screws will then lock frictionally in the grooves 21, 22 of the heads 18, 19 of the pins. As a result, the extension bar 27 is connected both mechanically and frictionally to the fitting part 5. Because, after installation of the door leaf 2, the extension bar 27 is only a short distance above the floor, and because the screw 33 is screwed into the extension bar 27 until it is flush with the end surface, a fitting 1 is created which is both tamper-proof and visually attractive.

The top fitting 1 is installed in the same way as described above, except that the stabilizing rod 29 is inserted before the final attachment of the corresponding extension bar 27 to the upper fitting 1. The ends 36 of the rod 29 are inserted into the bores 32 of enlarged cross section in the associated extension bar 27. The O-rings 38 are thus squeezed when the parts are inserted into each other and form a sufficiently strong nonpositive connection between the various components.

The final step of the installation process of the door leaf 2 into the door opening between the preexisting stationary upper and lower bearing points is described briefly below. The rotational support body 11 of the bottom fitting 1 is set down onto the corresponding lower bearing pin, and the door leaf 2 is pivoted into the plane of the bearing axis. Before that, the bearing body 40 is set by its interior bushing 42 onto the upper bearing pin of the door leaf 2. Then the door leaf 2 can be pivoted completely into the bearing axis of the door leaf 2, and as this occurs, the bearing space 39, which is open on one side, moves over and encloses the bearing body 40. The bearing body 40 is then given its final precision adjustments and fixed in position in the bearing space 39 by means of the attachment shoulder 46 and the slot 41. The cover 43 can now be clipped in place to seal the bearing space 39 and the bearing body 40 enclosed therein.

What is claimed is:

1. A fitting system for rotatable support of a glass door leaf having a top, a bottom, a bearing axis extending between the top and the bottom in the plane of the door, and at least one mounting recess on the axis at the top or the bottom, the fitting system comprising:

at least one fitting received in a respective mounting recess, each fitting comprising a first fitting part, a second fitting part, an intermediate space between the fitting parts, a contact surface facing the intermediate space on each of the fitting parts, a pair of threaded blind holes in the first fitting part, and a pair of through holes in the second fitting part;

a pair of pins received in the through holes and threaded into the blind holes for drawing the contact surfaces against the door leaf; and an extension bar which is attached to the second fitting part over the pins and parallel to the plane of the door leaf, wherein the second fitting part has a receiving channel and the pins have heads which project into the receiving channel when the contact surfaces are drawn against the door leaf, the extension bar having transverse bores which receive the heads when the extension bar is received in the receiving channel so that the extension bar completely covers the heads of the pins.

2. The fitting system of claim 1, wherein the heads of the pins have circumferential grooves and the extension bar has opposed ends provided with threaded axial bores which terminate at said transverse bores, whereby screws received in said axial bores can engage in said circumferential grooves to clamp said extension bar to said fitting.

3. The fitting system of claim 1, wherein the heads of the pins have axially oriented hexagonal sockets.

4. The fitting system of claim 1, wherein each said extension bar is provided with an axial bore, said system further comprising a rod having at least one end of reduced diameter which is received in said axial bore.

5. The fitting system of claim 4, wherein the at least one end is provided with at least one circumferential groove in which an O-ring can be installed so that the at least one end is received in the axial bore in a frictionally locking manner.

6. The fitting system of claim 4, wherein the rod is symmetrically designed with opposite ends of reduced diameter.

7. The fitting system of claim 1, further comprising a pair of protective inserts received in said intermediate space between respective said contact surfaces and said door leaf.

8. The fitting system of claim 1, wherein said at least one fitting further comprises a web connecting said first and second parts to form an integral unit.

9. The fitting system of claim 8, further comprising a bearing space formed in the web, whereby a bearing pin of a closer shaft of a door closer can be received nonrotatably in the bearing space.

10. The fitting system of claim 9, wherein the bearing space is open on one side.

11. The fitting system of claim 10, further comprising a bearing body which is laterally inserted into the bearing space and fixed therein.

12. The fitting system of claim 11, wherein said bearing body is fixable in a desired position in said bearing space.

13. The fitting system of claim 11, further comprising a bushing received in said bearing body.

14. The fitting system of claim 10, further comprising a cover received over the bearing space.

15. The fitting system of claim 14, wherein the cover has a lateral surface which fits flushly with an adjacent surface of the fitting.

16. The fitting system of claim 14, wherein said cover comprises clips for fixing the cover to the fitting.

17. The fitting system of claim 1, wherein said fitting and said extension bar are castings.

* * * * *